US009754754B2

(12) United States Patent
Kawase et al.

(10) Patent No.: US 9,754,754 B2
(45) Date of Patent: Sep. 5, 2017

(54) MULTIPOLAR FUSIBLE LINK

(71) Applicant: Pacific Engineering Corporation, Ogaki-shi (JP)

(72) Inventors: Fumiyuki Kawase, Ogaki (JP); Masahiro Kimura, Ogaki (JP); Tatsunori Kobayashi, Ogaki (JP)

(73) Assignee: Pacific Engineering Corporation, Ogaki-shi (JP)

( * ) Notice: Subject to any disclaimer, the term of this patent is extended or adjusted under 35 U.S.C. 154(b) by 58 days.

(21) Appl. No.: 14/781,478

(22) PCT Filed: Mar. 25, 2014

(86) PCT No.: PCT/JP2014/001682

§ 371 (c)(1),
(2) Date: Nov. 11, 2015

(87) PCT Pub. No.: WO2014/171074

PCT Pub. Date: Oct. 23, 2014

(65) Prior Publication Data

US 2016/0126048 A1 May 5, 2016

(30) Foreign Application Priority Data

Apr. 17, 2013 (JP) ..... 2013-086363
Jul. 18, 2013 (JP) ..... 2013-149288

(51) Int. Cl.
*H01H 85/08* (2006.01)
*H01H 1/58* (2006.01)
(Continued)

(52) U.S. Cl.
CPC ..... *H01H 85/08* (2013.01); *H01H 1/58* (2013.01); *H01H 85/10* (2013.01); *H01H 85/12* (2013.01);
(Continued)

(58) Field of Classification Search
CPC ..... H01H 85/08; H01H 1/58; H01H 85/10; H01H 85/12; H01H 2085/0555; H01H 85/153
(Continued)

(56) References Cited

U.S. PATENT DOCUMENTS 5,977,859 A * 11/1999 Kawamura ..... H01H 85/044 29/623
2009/0068894 A1* 3/2009 Ohashi ..... H01R 11/12 439/620.26
(Continued)

FOREIGN PATENT DOCUMENTS

JP 10-199396 A 7/1998
JP 2001-273848 A 10/2001
JP 2012-230856 A 11/2010

OTHER PUBLICATIONS

Original and English translation of International Search Report for PCT/JP2014/001682, dated May 13, 2014 (3 pages).

*Primary Examiner* — Anatoly Vortman
*Assistant Examiner* — Stephen Sul
(74) *Attorney, Agent, or Firm* — Shumaker, Loop & Kendrick, LLP

(57) ABSTRACT

The invention in this application aims to provide a multipolar fusible link in which its lateral width can decrease while its entire height does not increase. A multipolar fusible link (100) includes: an input terminal (110); a bus bar (120) through which an electric current input from the input terminal (110) flows; and a plurality of terminals (140) connected to the bus bar (120) via fusible sections (130). By changing a shape of a lower edge (122) of the bus bar (120) to which the fusible sections (130) are connected, a width between the lower edge (122) and an upper edge (121) positioned opposite the lower edge (122) is changed in accordance with the fusible sections (130) connected to the
(Continued)

lower edge (122). In addition, shapes of the fusible sections (130) connected to the lower edge (122) are changed so that their lateral widths decrease.

11 Claims, 5 Drawing Sheets

(51) Int. Cl.
*H01H 85/12* (2006.01)
*H01H 85/10* (2006.01)
*H01H 85/153* (2006.01)
*H01H 85/055* (2006.01)

(52) U.S. Cl.
CPC ... *H01H 85/153* (2013.01); *H01H 2085/0555* (2013.01)

(58) Field of Classification Search
USPC ..... 337/295
See application file for complete search history.

(56) References Cited

U.S. PATENT DOCUMENTS

2014/0043134 A1* 2/2014 Onoda ..... H01H 85/10
337/283
2014/0061852 A1* 3/2014 Newberry ..... H01H 85/046
257/529

* cited by examiner

MULTIPOLAR FUSIBLE LINK

TECHNICAL FIELD

The invention in this application relates to a multipolar fusible link to be used mainly for, for example, an electric circuit in an automobile.

BACKGROUND ART

To date, multipolar fusible links have been used to protect various electrical instruments in an automobile or the like against overcurrent from the battery. As illustrated in FIG. 4(*a*), a multipolar fusible link 200 known in the art includes: as main components, an input terminal 210; a bus bar 220 having a substantially rectangular shape in a planar view through which an electric current input from the input terminal 210 flows; and a plurality of terminals (240A to 240D) connected to the bus bar 220 via fusible sections (230A to 230D).

The input terminal 210 in the multipolar fusible link 200 is connected to a battery or some other power source, whereas the terminals (240A to 240D) are connected to various electrical instruments. In this way, a configuration in which fuses are provided between the battery or power source and the electric circuits in the electrical instruments is created. If an unexpected high current flows through one of the electric circuits, the corresponding fusible section 230 is heated and blown by the high current, protecting this electrical instrument against overcurrent that would flow through it.

The multipolar fusible link 200 is provided with the fusible sections 230 having different ratings which are connected between the plurality of terminals 240 and the bus bar 220. In the multipolar fusible link 200 illustrated in FIG. 4(*a*), for example, the fusible section 230A having a rating of 50 A (amperes), which is positioned close to the input terminal 210, is connected to the bus bar 220, and the three fusible sections 230B to 230D each having a rating of 40 A, which are positioned adjacent to the fusible section 230A, are sequentially connected to the bus bar 220. In the drawing, the ratings of the fusible sections are depicted over the terminals 240 to which these fusible sections are connected, for the sake of convenience.

In general, when the rating of a fusible section decreases, its entire length is increased in order to increase its resistance. As illustrated in FIG. 4(*b*), for example, the fusible section 230E having a rating of 40 A has a shape in which three arms (arms 1, 2, and 3) are interconnected with two links (links 1 and 2). It can be found that the entire length of a fusible section 230E is greater than that of the fusible section 230A having a rating of 50 A illustrated in FIG. 4(*a*).

As the entire length of a fusible section increases, its height also increases and, as a result, the overall height of the multipolar fusible link with this fusible section increases. In this case, to decrease the height of a fusible section to the maximum extent possible, its shape needs to be changed into a substantially Z shape, as illustrated in FIG. 4(*c*).

More specifically, as illustrated in FIG. 4(*c*), an angle β (refer to FIG. 4(*b*)) between the arms needs to be changed into a smaller angle α1 without changing the entire length of the fusible section (i.e., without changing the lengths of the arms). It can be found that a height Hα1 (see FIG. 4(*c*)) of a fusible section 230E' with the angle α1 is less than a height HP (see FIG. 4(*b*)) of the fusible section 230E with the angle β.

In the multipolar fusible link 200 illustrated in FIG. 4(*a*), the shapes of the fusible sections 230B to 230D are changed into the shape of the fusible section 230E' with the height Hα1 illustrated in FIG. 4(*c*). As a result, the height of the multipolar fusible link 200 is made low, namely, equal to H0=(c0+Hα1+d0). Here, c0 denotes the height of the bus bar 220, and d0 denotes the height of the terminals 240 (the height of all the terminals 240A to 240D is equal to d0).

The angle between the arms has a lower limit that is dependent on design specifications. Herein, it is assumed that the angle between the arms in a fusible section cannot be decreased to less than α1, for convenience of explanation. In addition, it is assumed that when the angle between the arms is set to α1, the height Hα1 of the fusible section can no longer be decreased.

Unfortunately, as described above, if the shape of a fusible section is changed so that the angle between its arms decreases and its height thereby decreases, the lateral width of the fusible section is increased from Lβ (see FIG. 4(*b*)) of the fusible section 230E to Lα1 (see FIG. 4(*c*)) of the fusible section 230E'. Consequently, the overall lateral width of the multipolar fusible link including the fusible section 230E' increases. On the contrary, if the shape of the angle between the arms is greatly changed so that the lateral width of the fusible section decreases and the overall lateral width of the multipolar fusible link thereby decreases, the height of the fusible section 230E increases as illustrated in FIG. 4(*b*). Consequently, the overall height of the multipolar fusible link increases.

As described above, if the shape of a fusible section is changed so that the overall height of the multipolar fusible link decreases, the overall lateral width of the multipolar fusible link increases. On the other hand, if the shape of a fusible section is changed so that the overall lateral width of the multipolar fusible link decreases, the overall height of the multipolar fusible link increases. This trade-off makes it difficult to determine the height and lateral width of a multipolar fusible link, which can be problematic.

SUMMARY OF THE INVENTION

The invention in this application has been made in light of the above problem with an object of providing a multipolar fusible link that is less dependent on a trade-off between its entire height and lateral width and thus has a higher degree of design flexibility in the entire height and lateral width.

A multipolar fusible link of the invention in this application includes: an input terminal; a bus bar through which an electric current input from the input terminal flows; and a plurality of terminals connected to the bus bar via fusible sections. By changing a shape of a lower edge of the bus bar to which the fusible sections are connected, a width between the lower edge and an upper edge positioned opposite the lower edge is changed in accordance with the fusible sections connected to the lower edge. In addition, shapes of the fusible sections connected to the lower edge can be changed in accordance with the width.

According to the feature described above, the width between the lower and upper edges of the bus bar in a height direction (referred to below as "the height of the bus bar" for the sake of simplification) is changed in accordance with the change in the shape of the lower edge. More specifically, the height of the bus bar is decreased in accordance with the change in the shape of the lower edge. The decrease in the height of the bus bar enables a larger space to be reserved on the side of the lower edge. This space allows for a change in the shape of a fusible section connected to the lower edge.

As a result of changing the shape of the fusible section so that its lateral width decreases, the overall lateral width of the multipolar fusible link including this fusible section decreases.

The decrease in the height of the bus bar makes it possible to reserve a larger space for arranging the fusible sections in a height direction. Therefore, the multipolar fusible link can have a smaller overall height than an existing multipolar fusible link.

The multipolar fusible link of the invention in this application configured above can be small in overall height and in overall lateral width. Thus, the multipolar fusible link can be installed inside a compact fuse box. The multipolar fusible link is formed by stamping a conductive metal piece. Therefore, a lot more multipolar fusible links, which are small in overall height and in overall lateral width, can be fabricated from a single metal plate. This results in the enhancement of the fabrication yield.

The shapes of the fusible sections connected to the lower edge can be changed into any given shapes within a space on the side of the lower edge which is created as a result of decreasing the height of the bus bar. Thus, the shape of a fusible section may be changed as appropriate so that the lateral width of the multipolar fusible link including this fusible section decreases while the height thereof is maintained as it is, or so that the height of the multipolar fusible link including this fusible section decreases while the lateral width thereof is maintained as it is.

The multipolar fusible link of the invention in this application is characterized in that the shape of the lower edge of the bus bar is changed so that the width between the lower and upper edges of the bus bar decreases from the input terminal toward an end edge positioned opposite the input terminal.

An electric current is input to the multipolar fusible link from the input terminal. Then, the current flows through the bus bar while parts of the current which branch off therefrom sequentially flow into downstream terminals. Consequently, with increasing distance from the input terminal, a larger number of branch currents flow into terminals, that is, the current flowing through the bus bar is decreased. For this reason, the width of the bus bar in a height direction (referred to below as "the height of the bus bar" for the sake of simplification) can be changed in accordance with the decrease in the current flow. More specifically, the end edge positioned opposite the input terminal can be formed so as to be smaller in width than the input terminal. In this way, the height of the bus bar can be optimized in accordance with a current flowing through it.

Further, since the end edge of the bus bar can be smaller in height than the input terminal, a larger space for changing the shapes of the fusible sections are reserved toward the end edge. Therefore, the shape of a fusible section connected closer to the end edge can be changed so that its lateral width becomes smaller. This results in the decrease in the overall lateral width of the multipolar fusible link.

A multipolar fusible link, as described above, of the invention in this application is less dependent on a trade-off between its entire height and lateral width and thus has a higher degree of design flexibility in the entire height and lateral width.

BRIEF DESCRIPTION OF THE DRAWINGS

FIG. 3(*b*) is a plan view of the multipolar fusible link of the invention in this application to which an insulating housing is attached.

FIGS. 4(*b*) and 4(*c*) are plan views of a fusible section in the multipolar fusible link with its shape changed.

DETAILED DESCRIPTION

Some embodiments of the invention in this application will be described below with reference to the accompanying drawings. To facilitate a comparative review of both a multipolar fusible link of the invention and an existing multipolar fusible link, a height d0 of terminals, a height c0 of a bus bar on an input terminal side, and the entire length (arms' length) of fusible sections having the same rating are fixed in FIGS. 1 to 4, and the lower ends of the terminals are all arranged at the same level. It should be noted that the shape of a bus bar, ratings and shapes of fusible sections, and the like in embodiments that will be described below are exemplary, and do not limit the invention accordingly.

Figure 1:
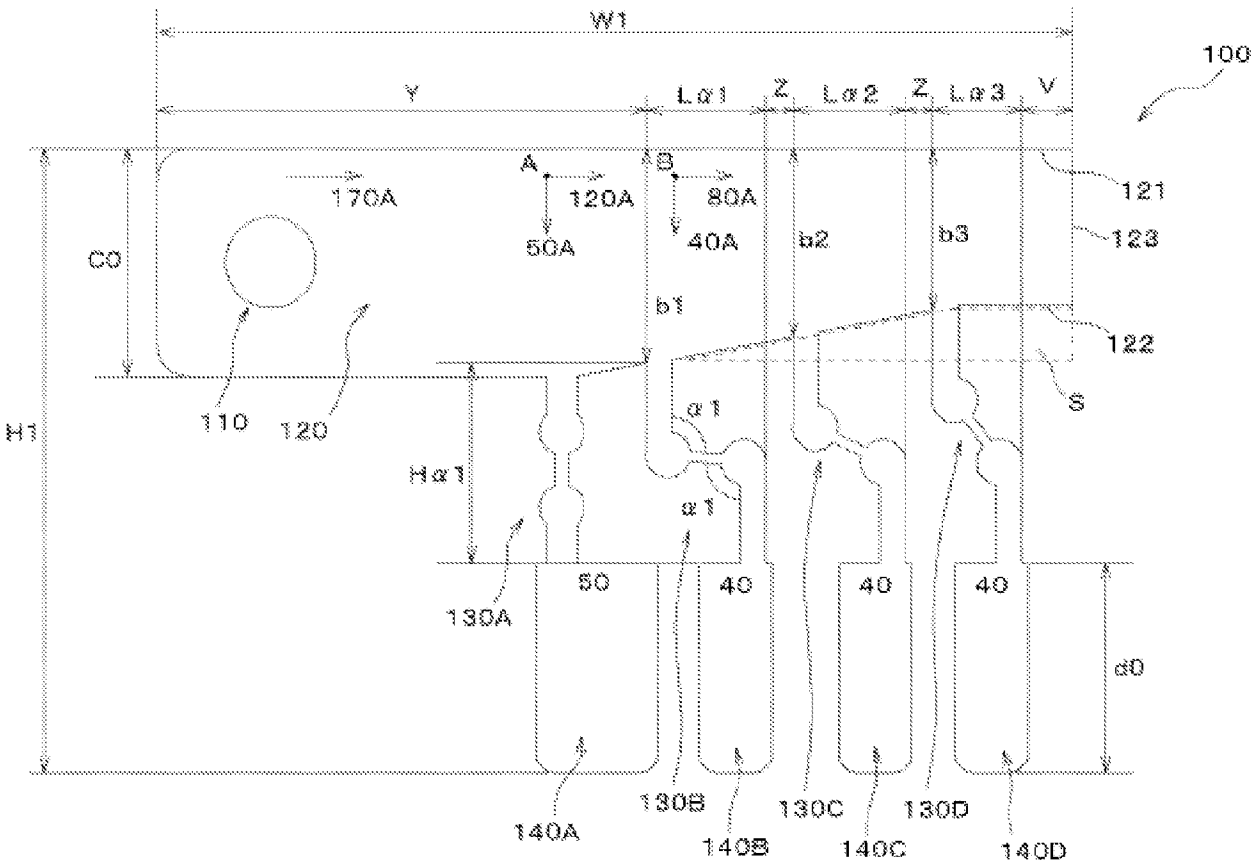
FIG. 1 is a plan view of a multipolar fusible link according to the invention in this application.

FIG. 1 illustrates a multipolar fusible link 100 of the invention in this application. This multipolar fusible link 100 includes: an input terminal 110; a bus bar 120; fusible sections 130 connected to a lower edge 122 of the bus bar 120; and terminals 140 via the corresponding fusible sections 130.

Figure 4A:
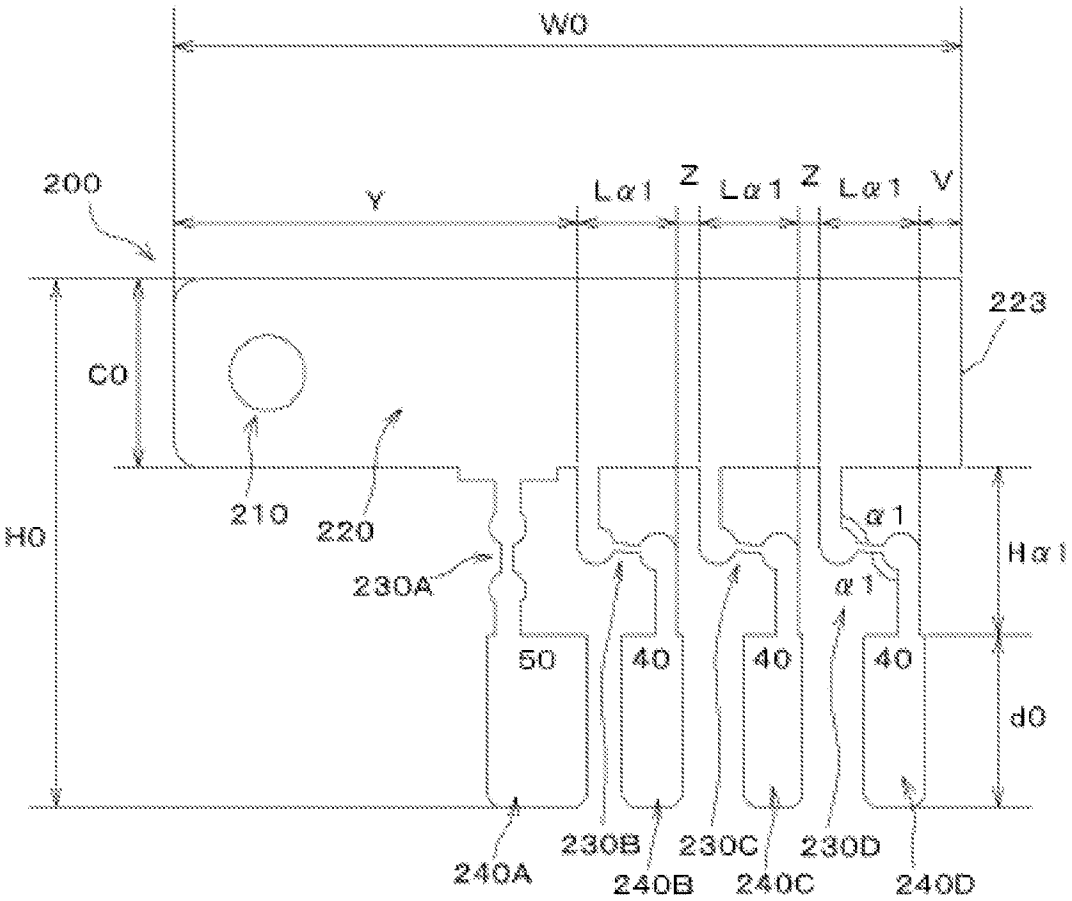
FIG. 4a (Prior Art)
FIG. 4(*a*) is a plan view of an existing multipolar fusible link.
Figure 4C:
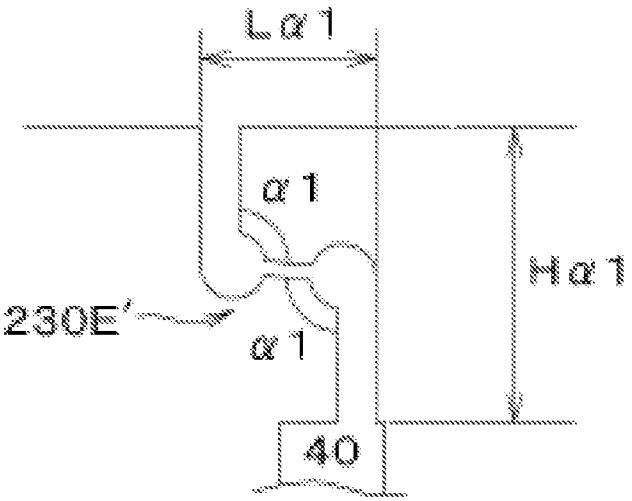
FIG. 4c (Prior Art)
Figure 4B:
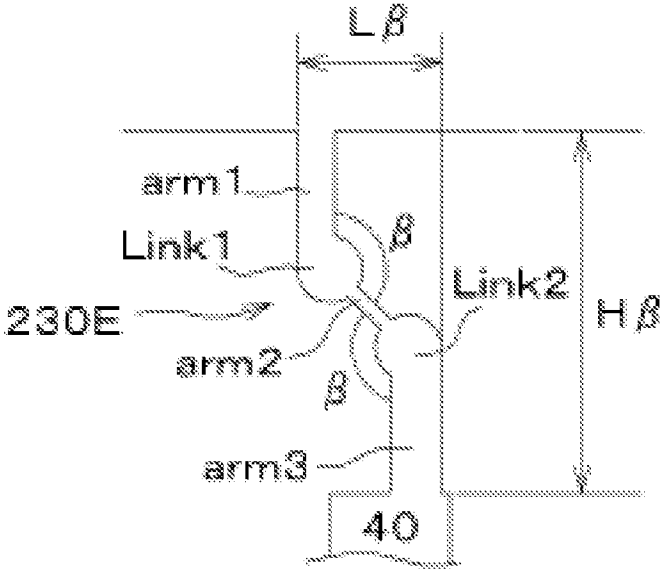
FIG. 4b (Prior Art)

The arrangement sequence of the fusible sections 130 is the same as that of an existing multipolar fusible link 200 (see FIG. 4(*a*)). More specifically, a fusible section 130A having a rating of 50 A (ampere) is connected close to the input terminal 110, and three fusible sections 130B to 130D each having a rating of 40 A are sequentially connected next to the fusible section 130A. The fusible sections 130B to 130D have different angles between the arms from fusible sections 230B to 230D, respectively, in the existing multipolar fusible link 200, but their entire lengths (arm lengths) are the same.

In the multipolar fusible link 100 of the invention in this application, as illustrated in FIG. 1, the height of the bus bar 120 is nonuniform as opposed to the existing bus bar 220 (see FIG. 4(*a*)). More specifically, it decreases toward an end edge 123. A reason why the height of the bus bar 120 is changed in this manner will be described below briefly.

An electric current that flows through the multipolar fusible link 100 is first input to the input terminal 110 and then flows through the bus bar 120 toward the end edge 123. In the course, parts of the current branch off and flow into the terminals 140 via the corresponding fusible sections 130. More specifically, suppose a current of 170 A is input to the input terminal 110. Then, while this current is flowing from the input terminal 110 toward the end edge 123, a current of 50 A branches off from the current and flows into the fusible section 130A. As a result, the current that flows from a point A toward the end edge 123 is equal to 120 A, which is decreased by the branch current of 50 A.

Accordingly, the height of the bus bar 120 at a location closer to the end edge 123 than the point A can be a height b1, which is less than the height c0 and proportional to the current of 120 A flowing at this location. In other words, the shape of the lower edge 122 can be changed into an inclined shape such that the height between the upper edge 121 and the lower edge 122 decreases.

Likewise, at a point B positioned closer to the end edge 123 than the point A, the current flowing toward the end edge 123 is equal to 80 A, which is decreased by a branch current of 40 A flowing into the fusible section 130B. Accordingly, the height of the bus bar 120 at a location closer to the end edge 123 than the point B can be a height b2, which is less than the height b1 and proportional to the current of 80 A flowing at this location.

As described above, with increasing distance from the input terminal 110, a current flowing through the bus bar 120 is decreased because a larger number of branch currents flow into fusible sections. Therefore, on the end edge 123 that is the farthest site from the input terminal 110, the height of the bus bar 120 becomes the minimum, or a height b3. In this way, the height of the bus bar 120 can be optimized such that it gradually decreases in proportion to a current flowing through it.

As illustrated in FIG. 1, the height of the bus bar 120 gradually decreases to b1, b2, and b3. This enables a gradually increasing space S for arranging the fusible sections (130B to 130D) to be reserved on the lower edge 122 of the bus bar 120. In this case, when the shape of a fusible section is changed so that it expands vertically, the multipolar fusible link 100 does not become greater in the overall height than an existing one, as will be described later.

Specifically, as illustrated in FIG. 1, the angle between the arms of the fusible section 130B is set to $\alpha 1$, which can no longer be decreased; and the height of the fusible section 130B is set to $H\alpha 1$, which is the minimum value. In addition, the height $H1=(b1+H\alpha 1+d0)$ of the multipolar fusible link 100 becomes less than the height $H0=(c0+H\alpha 1+d0)$ of the existing multipolar fusible link 200, due to the relationship of height b1<height c0.

In this embodiment, the lower edge of a bus bar is linearly inclined such that the height thereof decreases. However, there is no limitation on the shape of a bus bar, and its height may be changed differently. For example, the height of a bus bar may decrease in stages.

Next, a description will be given below of a fact that the lateral width of the multipolar fusible link 100 in this application can be decreased.

First, a description will be given of the entire lateral width of the existing multipolar fusible link 200, with reference to FIG. 4(*a*). In this multipolar fusible link 200, the distance from the edge of the input terminal 210 to the fusible section 230B is denoted by Y, and the distance between the fusible section 230B and the adjacent fusible section 230C is denoted by Z. Likewise, the distance between the fusible section 230C and the adjacent fusible section 230D is also denoted by Z, and the distance from the fusible section 230D to the end edge 223 is denoted by V. The same applies to the corresponding distances of the multipolar fusible link 100 in this application illustrated in FIGS. 1 to 3.

The lateral widths of the fusible sections 230B to 230D having the same shape are denoted by $L\alpha 1$. A lateral width W0 of the existing multipolar fusible link 200 is $W0=(Y+L\alpha 1+Z+L\alpha 1+Z+L\alpha 1+V)$.

Then, a description will be given of a lateral width W1 of the multipolar fusible link 100 in this application.

Figure 2:
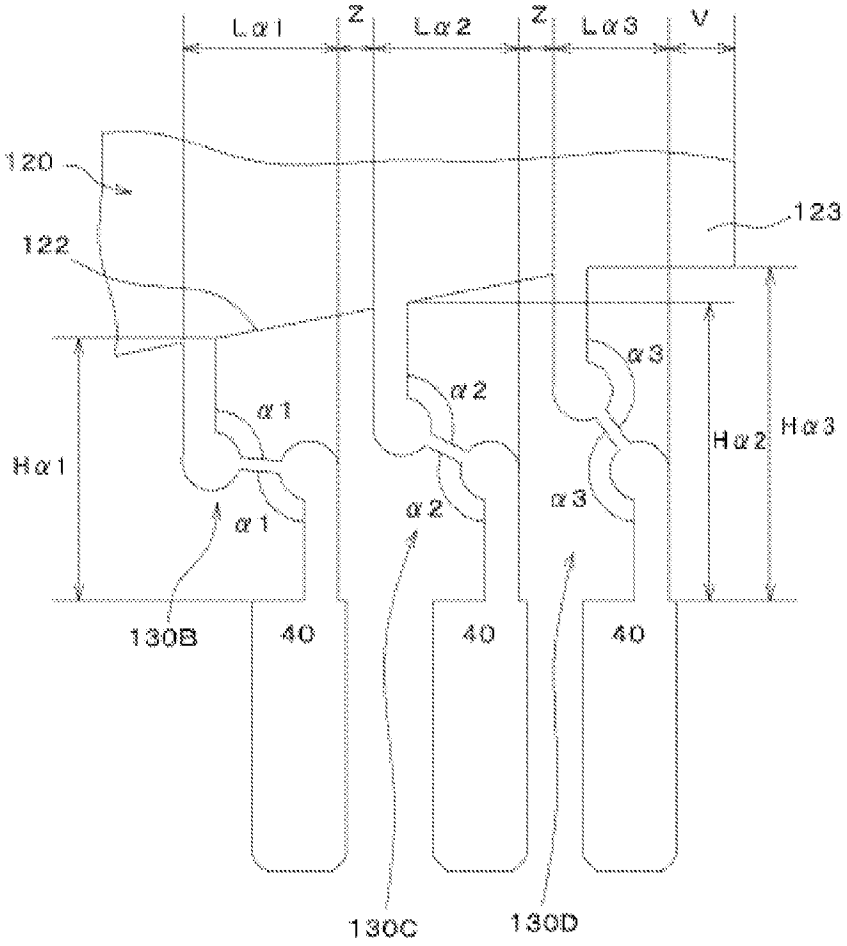
FIG. 2 is an enlarged, plan view of a surrounding area of a fusible section in the multipolar fusible link according to the invention in this application.

FIG. 2 illustrates the fusible sections 130B to 130D of the multipolar fusible link 100 in FIG. 1 in an enlarged manner. The height of the fusible section 130B is denoted by $H\alpha 1$, and the lateral width thereof is denoted by $L\alpha 1$. The lower edge 122 is inclined toward the end edge 123 while the height of the bus bar 120 gradually decreases. So, the space reserved in a height direction to form the adjacent fusible section 130C has a height $H\alpha 2$, which is greater than the height $H\alpha 1$ of the fusible section 130B. Therefore, the shape of the fusible section 130C can be changed so that it expands vertically (or so that the angle $\alpha 2$ between the arms becomes greater than the angle $\alpha 1$). Thus, a lateral width $L\alpha 2$ of the fusible section 130C becomes smaller than the lateral width $L\alpha 1$ of the fusible section 130B.

Further, the height of the bus bar 120 is further decreased at the location of the fusible section 130D formed adjacent to the fusible section 130C, whereby the space secured in a height direction to form the fusible section 130D has a height $H\alpha 3$, which is greater than the height $H\alpha 2$. Therefore, the shape of the fusible section 130D can be changed so that it expands vertically (or so that the angle between the arms becomes $\alpha 3$ that is greater than the angle $\alpha 2$). Thus, a lateral width $L\alpha 3$ of the fusible section 130D becomes smaller than the lateral width $L\alpha 2$ of the fusible section 130C.

Because of the relationship $L\alpha 1>L\alpha 2>L\alpha 3$ of the lateral widths of the fusible sections, as illustrated in FIG. 1, the lateral width $W1=(Y+L\alpha 1+Z+L\alpha 2+Z+L\alpha 3+V)$ of the multipolar fusible link 100 is smaller than the lateral width $W0=(Y+L\alpha 1+Z+L\alpha 1+Z+L\alpha 1+V)$ of the existing multipolar fusible link 200 (see FIG. 4(*a*)).

As described above, by changing the shape of the lower edge 122 so that the height of the bus bar 120 decreases, the space S for arranging the fusible sections can be reserved in a height direction and the shapes of the fusible sections can be changed so that their lateral widths decrease. Consequently, it is possible to not only make the height H1 of the multipolar fusible link 100 in this application less than that of the existing multipolar fusible link 200 but also make the lateral width W1 of the multipolar fusible link 100 smaller than that of the existing multipolar fusible link 200. In other words, it is possible to decrease the lateral width of a multipolar fusible link without increasing its overall height, as opposed to an existing one.

As illustrated in FIGS. 1 and 2, since the lower edge 122 is inclined with respect to the end edge 123, a larger space for arranging the fusible sections 130 is reserved in a height direction toward the end edge 123. For this reason, the shape of a fusible section 130 positioned closer to the end edge 123 can be changed more greatly so that its lateral width decreases.

In this example, the four fusible sections 130A to 130D are connected to the bus bar 120, but there is no limitation on the number of fusible sections. It should be understood that a lot more fusible sections can be connected. Also if a larger number of fusible sections are connected, the shape of a fusible section positioned closer to an end edge can be changed more greatly so that its lateral width decreases. This is because a larger space for arranging fusible sections is reserved in a height direction toward the end edge. Therefore, a multipolar fusible link in this application is more effective in decreasing its overall lateral width than an existing multipolar fusible link, especially when they have the same number of fusible sections.

Figure 3B:
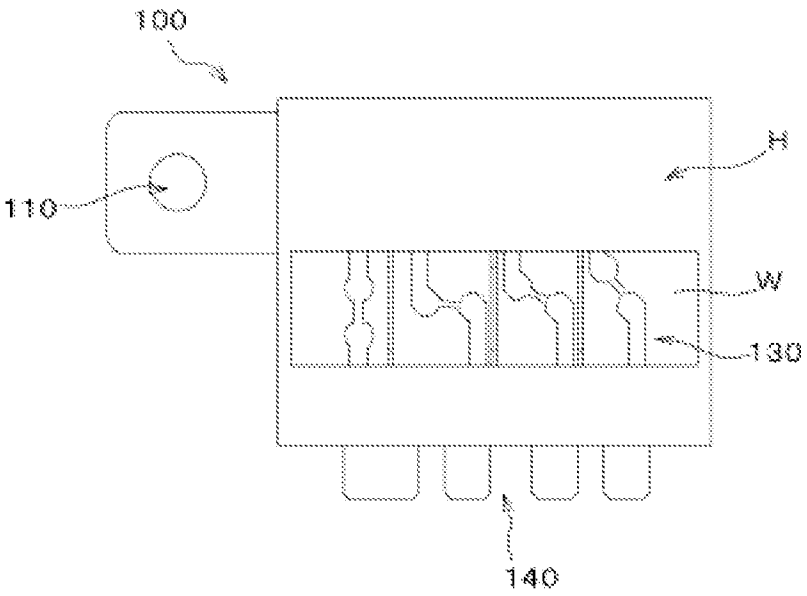
FIG. 3(*a*) is a plan view of the multipolar fusible link of the invention in this application.
Figure 3A:
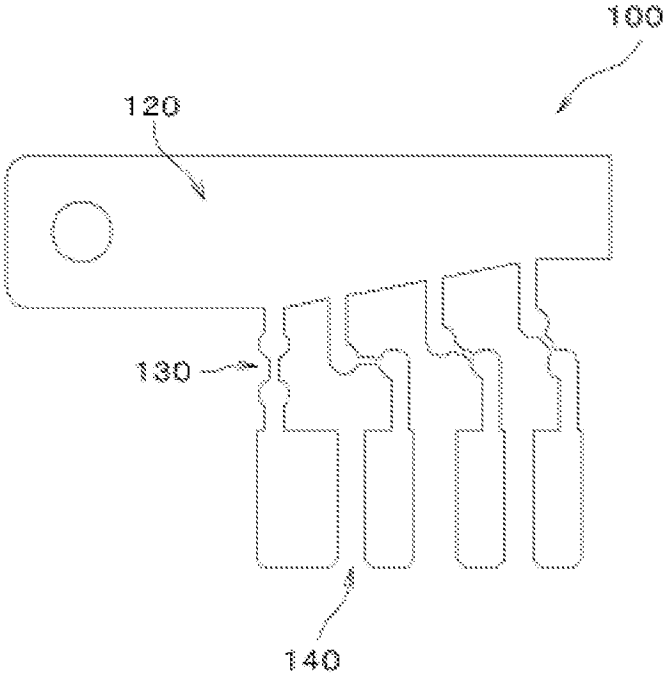

FIG. 3 illustrates an aspect in which an insulating housing is attached to a multipolar fusible link of the invention in this application.

A multipolar fusible link 100 is formed by stamping a metal plate into a shape as illustrated in FIG. 3(*a*), so that a bus bar 120, fusible sections 130, and terminals 140 are formed integrally. The metal plate may be made of a conducting metal such as copper. It should be noted that the bus bar 120, the fusible section 130, and the terminal 140 do not necessarily have to be formed integrally by stamping a single place. Alternatively, these members may be prepared separately and welded to one another.

Next, as illustrated in FIG. 3(*b*), an insulating housing H made of, for example, an insulating synthetic resin is attached to the multipolar fusible link 100 so as to sandwich it from the upper and lower sides. The input terminal 110 and the terminal 140 in the multipolar fusible link 100 are, however, exposed so that they can be connected to a fuse box and the like. The insulating housing H has a transparent window W that covers the fusible sections 130, allowing the fusible section 130 to be viewed from the outside. The multipolar fusible link 100 to which the insulating housing H is attached is installed inside, for example, a fuse box and then is used.

A multipolar fusible link of the invention in this application is not limited to the examples described above and can undergo various modifications and combinations within the scope of the claims and embodiments. Such modifications and combinations should be included within the scope of the patent right.

Intended uses of a multipolar fusible link of the invention in this application are not limited to electric circuits in automobiles. This multipolar fusible link can be used as fuses for different types of electric circuits, and obviously such fuses should also be included within the technical scope of the invention.

The invention claimed is:

1. A multipolar fusible link comprising:

an input terminal;

a bus bar through which an electric current input from the input terminal flows; and fusible sections positioned between and connected to the bus bar and a plurality of terminals such that the plurality of terminals are connected to the bus bar via the fusible sections, wherein:

a lower edge of the bus bar to which the fusible sections are connected varies such that a width between the lower edge of the bus bar and an upper edge of the bus bar positioned opposite the lower edge is gradually decreased from a portion to which the fusible section closest to the input terminal is connected towards the end edge opposite to the input terminal in an axial direction along a length of the bus bar, and lengths of the fusible sections vary in an inverse relationship to the widths of the portions of the bus bar to which the fusible sections are connected, wherein, as the bus bar linearly extends in the axial direction, the width of the fusible section decreases, the decrease of the width varies in proportion to the width between the lower edge of the bus bar and the upper edge of the bus bar in the axial direction of the bus bar.

2. The multipolar fusible link according to claim 1, wherein the axial direction along the length of the bus bar is a longitudinal axis of the multipolar fusible link.

3. The multipolar fusible link according to claim 1, wherein a portion of the bus bar between the upper and lower edge of the bus bar extending away from the input terminal is tapered.

4. The multipolar fusible link to claim 3, wherein the portion of the bus bar between the upper and lower edge of the bus bar extending away from the input terminal has an incline shape.

5. The multipolar fusible link according to claim 4, wherein the fusible sections increase in length along the longitudinal axis of the multipolar fusible link in a direction extending away from the input terminal, the length increase of the fusible sections being directly inversely proportional relative to the tapered portion of the bus bar.

6. The multipolar fusible link according to claim 3, wherein the portion of the bus bar between the upper and lower edge of the bus bar extending away from the input terminal has a plateau shape.

7. The multipolar fusible link according to claim 6, wherein the fusible sections increase in length along the longitudinal axis of the multipolar fusible link in a direction extending away from the input terminal, the length increase being directly inversely proportional relative to the tapered portion of the bus bar.

8. The multipolar fusible link according to claim 7, wherein each terminal in the plurality of terminals is uniform in height.

9. The multipolar fusible link according to claim 3, wherein the fusible sections increase in length along the longitudinal axis of the multipolar fusible link in a direction extending away from the input terminal, the length increase of the fusible sections being directly inversely proportional relative to width decrease of the tapered portion of the bus bar.

10. The multipolar fusible link according to claim 3, wherein each terminal in the plurality of terminals is uniform in height.

11. The multipolar fusible link according to claim 1, wherein each terminal in the plurality of terminals is uniform in height.

* * * * *